United States Patent [19]

Sagara et al.

[11] Patent Number: 4,552,447

[45] Date of Patent: Nov. 12, 1985

[54] VARIABLE MAGNIFICATION COPYING APPARATUS WITH MARGIN ERASE

[75] Inventors: Seiji Sagara, Yokohama; Yuuji Hasegawa, Tokyo, both of Japan

[73] Assignee: Canon Kabushiki Kaisha, Tokyo, Japan

[21] Appl. No.: 501,865

[22] Filed: Jun. 7, 1983

[30] Foreign Application Priority Data

Jun. 14, 1982 [JP] Japan ..... 57-100775

[51] Int. Cl.[4] ..... G03G 15/00

[52] U.S. Cl. ..... 355/3 R; 355/8; 355/55

[58] Field of Search ..... 355/3 R, 7, 8, 11, 3 ER, 355/1, 55, 67, 14 E

[56] References Cited

U.S. PATENT DOCUMENTS 4,008,954 2/1977 Ogawa et al. ..... 355/1
4,046,467 9/1977 Laskowski et al. ..... 355/3 R X
4,080,071 3/1978 Kobayashi ..... 355/14 E X
4,255,042 3/1981 Armitage, Jr. et al. ..... 355/3 R
4,334,763 6/1982 Honda et al. ..... 355/67 X

FOREIGN PATENT DOCUMENTS 2011647 7/1979 United Kingdom ..... 355/7

*Primary Examiner*—A. T. Grimley
*Assistant Examiner*—J. Pendegrass
*Attorney, Agent, or Firm*—Fitzpatrick, Cella, Harper & Scinto

[57] ABSTRACT

A variable magnification copying apparatus includes first erasing element for removing electrical charge from the photosensitive member at an area outside the area of image of the original and second erasing element for removing electrical charge from the outside area, in cooperation with said first erasing element when the magnification is less than a predetermined value.

22 Claims, 12 Drawing Figures

VARIABLE MAGNIFICATION COPYING APPARATUS WITH MARGIN ERASE

BACKGROUND OF THE INVENTION

1. Field of the Invention

This invention relates to a variable magnification copying apparatus, more particularly, a copying apparatus capable of continuously or stepwisely changing the magnification. (Throughout the Specification and Claims, the term "magnification" is intended to cover enlargement, reduction and unit magnification.)

2. Description of the Prior Art

In electrophotographic machines, a photosensitive member (an image bearing member) is electrically charged, and then exposed, through optical elements, to image light which is reflected by the original to be copied.

In the electrophotographic machines capable of changing the magnification, the boundaries between the range of the photosensitive member within which the image of the original is formed and the range thereof outside such a range, is not constant, that is, it changes with the magnification selected. The area not exposed to the image light is not deprived of the electric charge and will be developed at the subsequent developing station. Further, the toner deposited to such an area is transferred to the transfer material at the transfer station to undesirably provide a black frame on the transfer material. This is disadvantageous also from the economical standpoint, since it wastes the developer agent, also since it raises the frequency of the replenishment of the developer agent. In addition, it puts much load on the subsequent cleaning station wherein the untransferred developer is removed from the photosensitive member. This problem has been solved by an additional exposure by which the area of the photosensitive member which is not exposed to the image light is exposed to additional light to remove the charge from such an area (hereinafter called "margin erasure").

However, in a variable magnification copying apparatus wherein the magnification can change continuously or stepwisely, the unilluminated area also changes continuously or stepwisely, so that the width of the additional exposure or the margin erasure has to be controlled continuously or stepwisely. A highly efficient device for charge removal for the margin erasure has been desired.

SUMMARY OF THE INVENTION

The object of the present invention is to provide a variable magnification copying apparatus provided with means for removing the electric charge from the unilluminated area of the photosensitive member.

Another object of the present invention is to provide a variable magnification copying apparatus wherein the magnification can be changed continuously or stepwisely, and wherein means is provided to remove the electric charge from the unilluminated area which varies in accordance with the magnification selected.

The other objects, features and advantages of the present invention will be apparent from the following more particular description of the preferred embodiments of the invention in conjunction with the accompanying drawings.

DETAILED DESCRIPTION OF THE PREFERRED EMBODIMENTS

Figure 1:
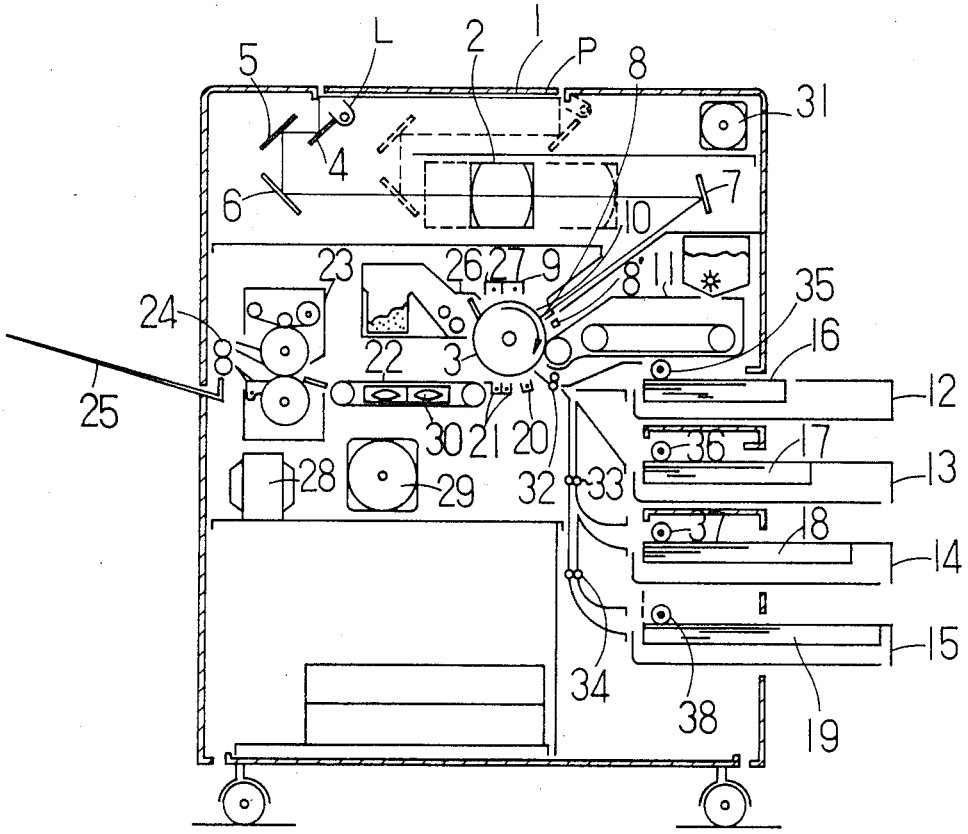
FIG. 1 shows a front cross-sectional view of the variable magnification copying apparatus according to an embodiment of the present invention.

Referring to FIG. 1, there is shown a variable magnification copying apparatus according to the present invention, which comprises an original supporting member 1 for carrying an original P to be reproduced, original illuminating lamp L for illuminating lamp, reflecting mirrors 4, 5, 6 and 7 for forming an optical path, zoom lens 2, and a photosensitive drum 3, as an example of an image bearing member, which includes a conductive base and an electrostatic photosensitive layer thereon. The light emitted by the illuminating lamp L is reflected by the original P and then directed to the imaging portion 8 of the photosensitive drum 3, through the mirrors 4, 5 and 6, zoom lens 2, mirror 7, in the order named. The mirrors 4, 5 and 6 and the illumination lamp L reciprocate between the positions shown by the solid lines and the positions shown by the broken lines to scan the original P. The copying apparatus further comprises a primary charger 9, a secondary charger 10, a developing device 11 where the electrostatic latent image is visualized by the developer agent. The developing device may be of wet developer type or dry developer type. The copying apparatus is provided with a margin erasure device 8' for removing, dissipating or erasing the electric charge from such an area of the photosensitive drum 3 that are not illuminated by the image light, that is, the light reflected by the area of the original P. The margin erasure device exposes, to light, the unilluminated area of the photosensitive drum 3 which varies in accordance with the magnification selected, which will be described in detail hereinafter.

To the copying machine, transfer material, which is copy paper in this embodiment, is fed selectively from either one of the cassettes 12, 13, 14 and 15 which contain the transfer materials 16, 17, 18 and 19, respectively. The copying machine includes a transfer charger 20 by which the image on the photosensitive drum 3 is transferred onto the transfer material fed out of one of the cassettes 12, 13, 14 and 15, and includes a separation discharger 21 which aids the separation of the transfer material from the photosensitive drum 3 after the image transfer, conveying belt 22 for conveying the transfer material to a fixing device 23 where the transferred image is fixed on the transfer material. The transfer material is then discharged by discharging rollers 24 to a tray 25.

Around the photosensitive drum 3, there is provided a cleaning device 26 and the precharger 27. The copying apparatus further includes a transformer 28 for providing power to the various elements such as corona dischargers, a driving motor for driving the various elements such as the photosensitive drum 3, DC servomotor 31 for driving the mirrors 4, 5 and 6 are the illumination lamp L in synchronizm with the rotation of the photosensitive drum 3, suction fan to assist conveyance of the transfer material, registration rollers 32 for feeding the transfer material into registration with the image formed on the photosensitive drum 3, conveying rollers 33 and 34 for conveying the transfer material toward the image transferring device, and feed-out rollers 35, 36, 37 and 38 for feeding the transfer material one by one out of the associated cassettes.

Figure 2A:
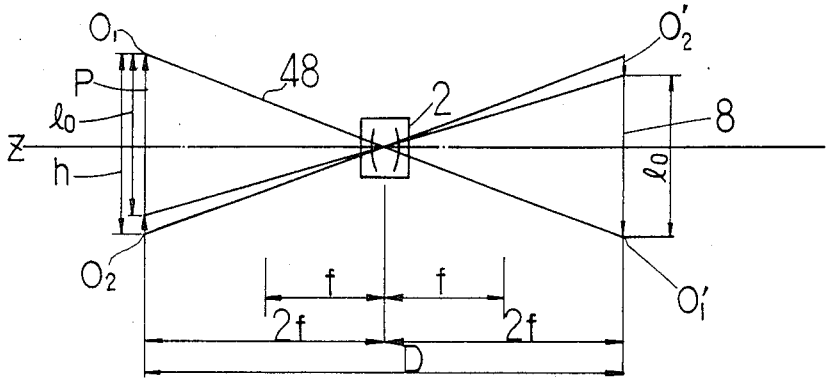
FIG. 2A illustrates a variable magnification optical system of a side registration type to which the present invention is applied.

FIG. 2A schematically shows the principal structure of the variable magnification optical system used in the device of the present invention. The optical system is shown as a side registration type wherein a side of the original is imaged at a constant longitudinal position of the photosensitive drum 3, irrespective of the magnification ratio. The optical system includes a zoom lens 2, and various mirrors which are not shown for the sake of simplicity, but will be understood from FIG. 1. The original P is imaged on the imaging portion 8 of the photosensitive drum 3.

FIG. 2A shows the states of the elements when the magnification is set to the unit, i.e., one-to-one copy. The zoom lens 2 is equidistant from the original P and the imaging portion or plane 8 by the distance 2f in the opposite direction, wherein f is the set focal length of the zoom lens 2. The width $l_0$ of the original P is imaged on the imaging plane 8 over the entire width of the photosensitive drum 3 which is also $l_0$, by the zoom lens 2.

Figure 2B:
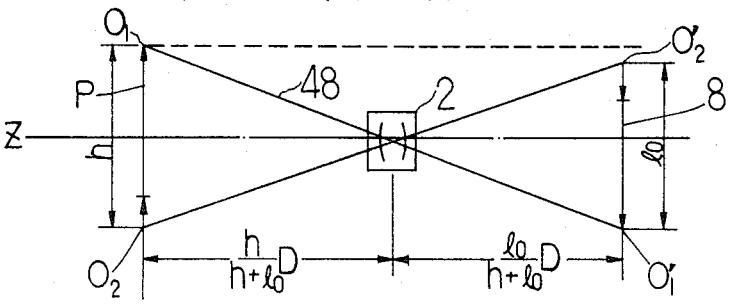
FIG. 2B illustrates the state of the optical system of FIG. 2A at a different magnification ratio.

FIG. 2B shows the state of the same optical system at a different magnification, at which the width of the original P plus the width of the charge removing means, which will be described in detail hereinafter, is projected onto the photosensitive drum 3 over the entire width $l_0$ thereof. That is, the width h (the width of the original P plus the width of the charge removing means), is imaged as the width $l_0$ on the photosensitive drum. Because the optical system is of the side registration type, an end of the original is set to a constant position $0_1$, and the charge removing means is placed at the opposite end. For the same reason, the zoom lens 2 moves along the reference line 48 which is inclined with respect to its optical axis Z, so that the reference position $0_1$ is imaged at the position $0_1'$ of the imaging plane 8, independently of the magnification selected. In the state shown in FIG. 2B, the focal length of the zoom lens 2 is changed to $hl_0D/(h+l_0)^2$, where D is the distance between the original P and the imaging plane 8, which is constant. The zoom lens is now spaced from the original by $hD/(h+l_0)$. The width h at the original plane is imaged as width $l_0$ on the photosensitive drum 3, i.e., the full length thereof, so that the magnification is $l_0/h$. In this state, the photosensitive drum 3 does not have the unilluminated area, but it will be understood that this is the limit of the non-existence of the unilluminated area. That is, where the magnification is not less than $l_0/h$, there is no unilluminated area on the photosensitive drum 3, but, where the magnification is less than $l_0/h$, there exists the unilluminated area, which will be described in more detail in conjunction with FIG. 2C.

Figure 2C:
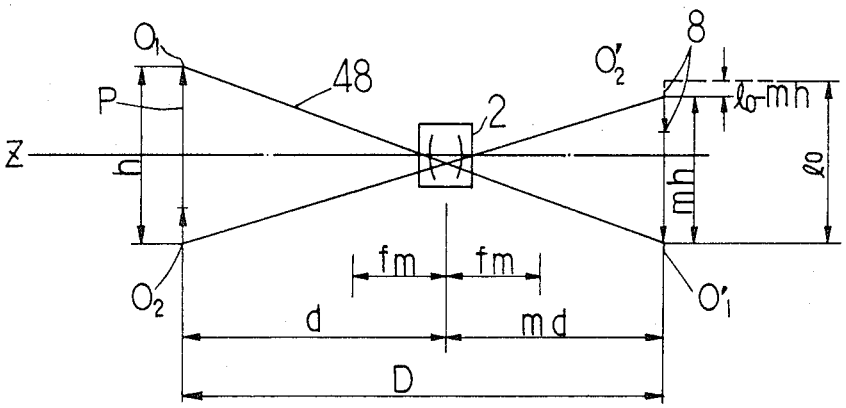
FIG. 2C illustrates the state of the optical system of FIG. 2A at a further different magnification ratio.

FIG. 2C shows the state of the same optical system at a greater reduction. As explained above, the zoom lens 2 is further moved toward the imaging plane 8 along the line 48, which is inclined with respect to its optical axis Z, so that the position $0_1'$, which is the image of the reference position $0_1$ of the original plane, does not change. In this state, the distance d between the original P and the zoom lens 2 is equal to $D/(m+1)$, and the focal length $f_m$ of the zoom lens 2 is $md/(m+1)$, and the distance between the zoom lens 2 and the imaging plane 8 is md, wherein m is the magnification, which is smaller than $l_0/h$, in this state. The width h (the width of the original P plus the width of the charge removing means), which is the distance between the point $0_1$ and point $0_2$, is imaged on the imaging plane 8 as the width mh. Since the imaging plane 8 has the width $l_0$ which is effective for the image formation and development, the width $(l_0-mh)$ is not illuminated. When the magnification m changes, the unilluminated width $(l_0-mh)$ changes, accordingly. Therefore, the margin erasure means 8' must erase the charge of the area which varies in dependence of the magnification selected.

Returning to FIGS. 1 and 2, an operator of the copying apparatus places an original P face down on the original supporting means, depresses a copy button (not shown) and selects a magnification. Then the zoom lens 2 sets it focal length to $dm/(m+1)$, and moves along the line 48, so that the image of the original P is formed on the imaging plane 8 at the selected magnification m without the change of the optical distance between the original plane and the imaging plane, and without changing the imaging position $0_1'$ of the reference position $0_1$ of the original plane, as explained hereinbefore. The distance between the zoom lens 2 and the imaging plane 8 is md, and the distance between the zoom lens 2 and the original P is d. If the magnification m is less than $l_0/h$, the image of the original plus the charge erasing means is formed on the imaging plane, i.e., the photosensitive drum 3, in the manner shown in FIG. 2C, so that the unilluminated width $(l_0-mk)$ is exposed to light by the margin erasure means 8', which will be described hereinafter.

When the copy start button (not shown) is depressed, the photosensitive drum 3 rotates in the clockwise direction in FIG. 1. The photosensitive drum is electrically charged by the primary charger. This mirror 4 and the original illumination lamp L start moving rightwardly in FIG. 1 at the speed which is 1/m of the peripheral speed of the photosensitive drum 3. Simultaneously, the mirrors 5 and 6 start moving, as a unit, in the same direction, but at the speed ½m of the drum peripheral speed. An image of the original P is formed on the surface of the photosensitive drum 3 by the optical system including mirrors 4, 5 and 6, zoom lens 2 and mirror 7. Upon this imaging, the portion of the photosensitive drum 3 surface which has been electrically charged by the primary charger 9, is subjected to the secondary charger 10, so that an electrostatic latent image is formed. The unilluminated area $(l_0-mh)$ is exposed to light by the margin erasure means 8', and becomes deprived of the electric charge which has been deposited thereonto by the primary charger 9. The electrostatic latent image is then developed by the developing device 11, and at this time, the unilluminated area, which has been discharged by the margin erasure means 8', is not deposited with the developer agent, so that only the image of the original P is developed. The transfer material or sheet fed out of one of the cassettes 12, 13, 14 and 15 is fed to the transfer station at a timing determined by the register rollers 32 in the manner that the transfer sheet is in registration with the image point $0_1'$ on the photosensitive drum 3. The developed image is then transferred by the transfer charger 20 to the transfer sheet, which is then separated from the photosensitive drum 3 with the aid of the separation charger 21, thereafter, fed to the fixing means 23, where the image is fixed on the sheet. Finally, the sheet bearing the fixed image is discharged by the discharging rollers 24 to the tray 25. The photosensitive drum 3 is cleaned by the cleaning means 26, so as to be free from the residual developer. The above process steps are repeated for the next copying operation. The operation, when there is no unilluminated area, is the same as the usual operation so that the explanation is omitted for the sake of simplicity.

Figure 3:
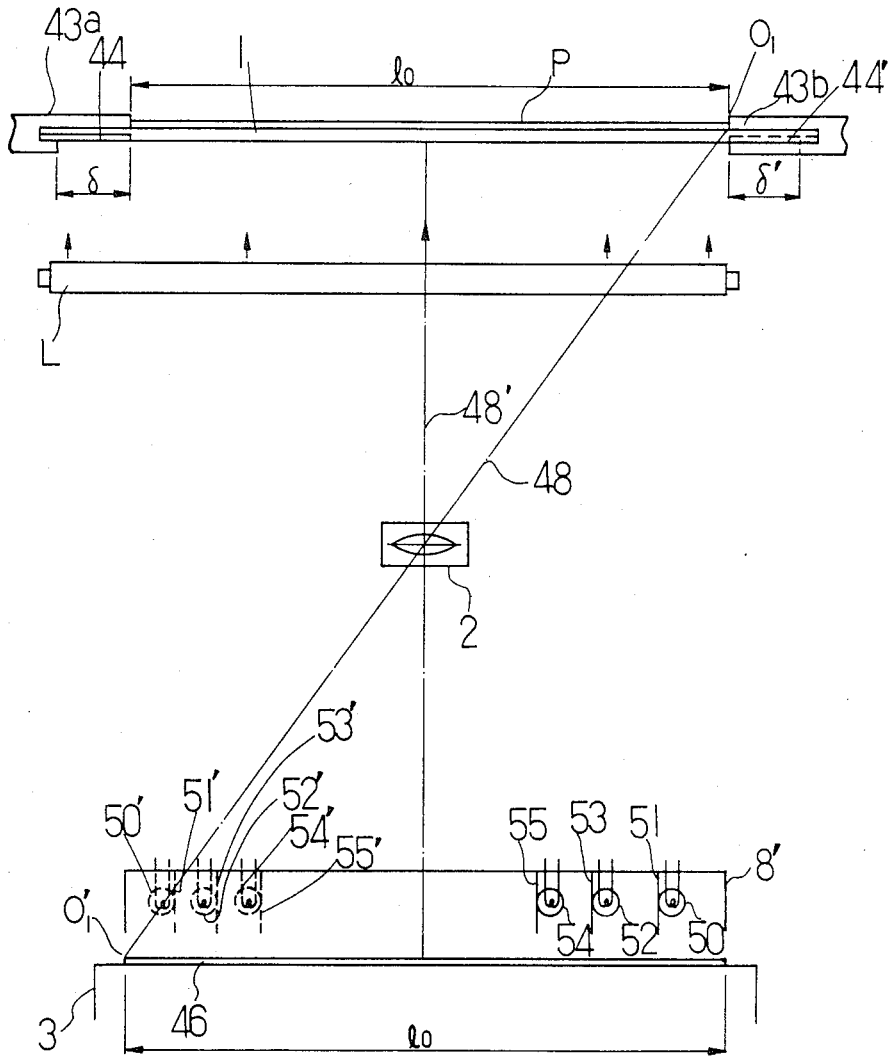
FIG. 3 shows a margin erasure device used with the apparatus of the present invention.

FIG. 3 shows the optical system having the margin erasure means, wherein the original supporting member 1 is provided with the supporting plate 43*a* and 43*b* for supporting the original supporting member 1. The lamp L shown therein illuminates the original P to be copied. The original supporting member 1 is further provided with a white plate 44 having width $\delta$, which is an example of the charge removing means. The white plate 44 is provided at an end of the original supporting member 1, extending in the original scanning direction. The light emitted from the illumination lamp L and reflected by the white plate 44 is projected onto a part of the photosensitive member 46 of the photosensitive drum 3, to remove the electric charge existing there. In place of the white plate 44, a proper optical element, such as an array of light emitting diodes having enough quantity of light to erase the charge may be used. The other various elements shown in this Figure are similar to the elements which have been described hereinbefore in conjunction with FIGS. 1, 2A, 2B and 2C, so that the explanation is omitted by giving the same reference numerals to the corresponding elements. The zoom lens 2 is moved along the line 48 which is the line connecting the point $0_1$ at the boundary with the support 43*b*, and the point $0_2$. In this Figure, the marging erasure means 8' is shown as having light emitting elements 50, 52 and 54 and partition plates 51, 53 and 55 adjacent thereto. The light emitting elements 50, 52 and 54 are rendered on or off in accordance with the magnification selected, by suitable control means (not shown).

Figure 4A:
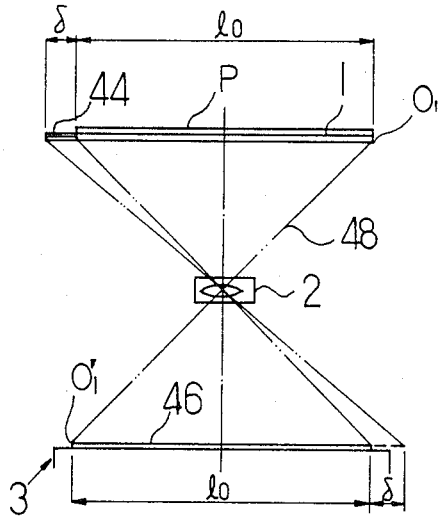
FIG. 4A shows the state of the optical system of FIG. 3, at a unit magnification.
Figure 4B:
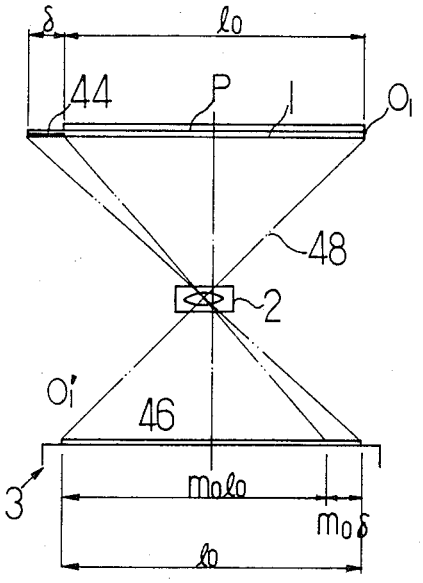
FIG. 4B shows the state of the optical system of FIG. 3 at a different magnification ratio.
Figure 4C:
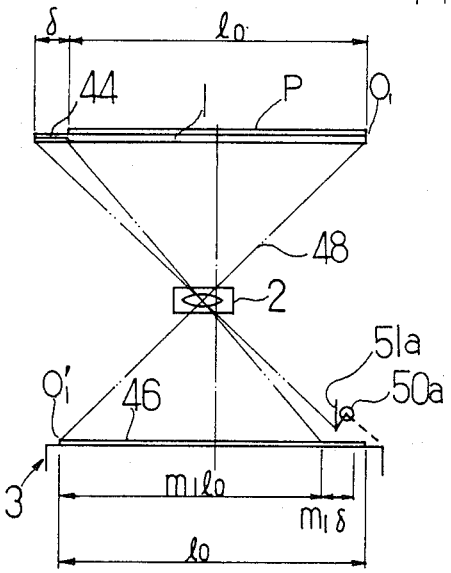
FIG. 4C shows the state of the optical system of FIG. 3 at a further different magnification ratio.

FIGS. 4A, 4B and 4C show the relationship between the original P and its image at different magnifications. As an example, those Figures deal with the side registration optical system, and show the margin erasure means 8' in a schematic manner for better understanding.

FIG. 4A shows the state of the optical system at the unit magnification, wherein the effective copyable width $(l_0+\delta)$, that is, the width of the original supporting member 1 plus the width of the white plate 44, is imaged on the photosensitive member 46 in the same size. Since the effective width of the photosensitive member 46 is also $l_0$, the light reflected by the white plate 44 is not projected onto the effective width of the photosensitive member 46, and therefore, only the image of the original is projected onto the photosensitive member 46, so that the transfer sheet has the image of the original P only.

FIG. 4B shows a state of the same system at a magnification $m_0$ where the image of the effective copyable width $(l_0+\delta)$ is equal to the effective width $l_0$ of the photosensitive member 46, that is, $m_0(l_0+\delta)=l_0$. In this state, it is apparent that $m_0$ equals to $l_0/(l_0+\delta)$. Then, the image of the original width plus white plate 44 occupies the entire width $l_0$ of the photosensitive member 46, so that there still does not exist an unilluminated width, thus requiring no operation of the margin erasure means 8'.

In consideration of the states shown in FIGS. 4A and 4B together, the margin erasure means 8' is not necessary to operate, when the magnification m is not less than $l_0/(l_0+\delta)$, since there is no unilluminated area in the effective area of the photosensitive member 46.

FIG. 4C shows the state of the same system at a magnification $m_1$ which is less than $l_0/(l_0+\delta)$, where the image of the original supporting means width $l_0$ has width $m_1l_0$ and the image of the white plate 44 width 6 has width $m_1\delta$. The sum of them is smaller than the effective width $l_0$ of the photosensitive member 46, so that, on the photosensitive member 46, there is an unilluminated area. The margin erasure means 8' is operated to turn the light emitting element 50*a* on. The width to be illuminated by the light emitting element 50*a* must be confined to the area which is beyond $m_1l_0$ as measured from the point $0_1'$ which is the image of the reference point $0_1$, although it can partly or entirely overlap the image of the white plate 44. The illuminating area of the element 50*a* cannot overlap any part of width $m_1l_0$, since otherwise the image of the original P can be destroyed. This confinement is effected by the partition 51*a*.

Figure 5:
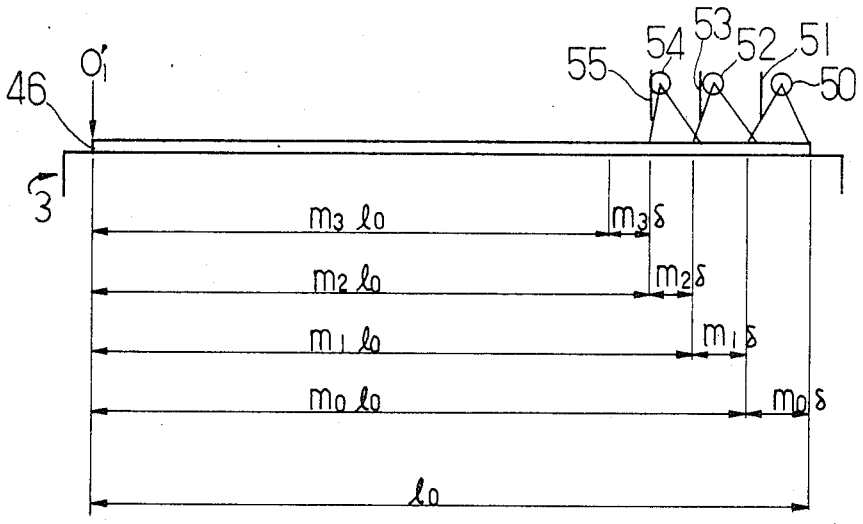
FIG. 5 shows the state of the exposure of the photosensitive member, in the device of FIG. 3.

FIG. 5 shows the positional relation between the light emitting elements 50, 52 and 54 and the photosensitive member 46. In this Figure, $l_0$, $m_0l_0$, $m_1l_0$, $m_2l_0$ and $m_3l_0$ are the widths of the image, on the photosensitive member 46, of the original supporting member 1, that is, the original P having the width $l_0$, at the magnification ratios 1, $m_0$, $m_1$, $m_2$ and $m_3$ $(1>m_0>m_1>m_2>m_3)$. Since the optical system is of the side registration type (not center registration type). The zoom lens 2 moves along the line 48 as explained hereinbefore, when the magnification is changed among those ratios. The focal length of the zoom lens 2 is $D/4$, $m_0D/(m_0+1)^2$, $m_1D/(m_1+1)^2$, $m_2D/(m_2+1)^2$ and $m_3D/(m_3+1)^2$ for the magnification 1, $m_0$, $m_1$, $m_2$, and $m_3$, respectively. The position of the zoom lens 2 is such that the ratio of (the optical path length between itself and the original P)/(the optical path length between itself and the photosensitive member) is 1/m. By those selections of the parameters, the zoom lens 2 forms the image of the original P at the magnification 1, $m_0$, $m_1$, $m_2$ or $m_3$, without changing the reference point imaging position $0_1'$, the width of the image being $l_0$, $m_0l_0$, $m_1l_0$, $m_2l_0$ and $m_3l_0$, respectively. In FIG. 5, $m_0\delta$, $m_1\delta$, $m_2\delta$ and $m_3\delta$ are the widths of the image, on the photosensitive member 46, of the white plate 44, similarly to FIG. 3.

The light emitting area of the light emitting element 50 is confined to the right, as viewed in FIG. 5, from the position of $(m_1l_0+m_1\delta)$ measured from the point $0_1'$, by the partition or blocking plate 51 for the reasons stated with FIG. 3.

Similarly, the light emitting area of the light emitting element 52 is confined to the right, as viewed in FIG. 5 from the position $(m_2l_0+m_2\delta)$ measured from the point $0_1'$ by the partition plate 53. The right part of the emitting area of the element 52 is defined so as to be overlapped at their marginal parts with each other.

Similarly, the light emitting area of the light emitting element 54 is confined to the right, as viewed in FIG. 5, for the position $(m_3l_0+m_3\delta)$ measured from the point $0_1'$ by the partition plate 55.

The operation of the margin erasure means will now be described. When the magnification m is set to a ratio not less than $l_0/(l_0+\delta)$ i.e., $m \geqq m_0$, the exposure of the photosensitive member 46 of the drum 3 to the light emitting element is not necessary, as explained with FIGS. 4A and 4B.

When the magnification m which is less than $l_0/(l_0+\delta)$, i.e., $m=m_1$, for example, is selected by depressing the magnification $m_1$ button (not shown), the focal length of the zoom lens 2 is changed to $m_1D/(m_1+1)^2$, and the position thereof is changed along the line 48 so as to set the ratio of (the length between itself and the original P)/(the length between itself and the imaging portion 8 of the photosensitive member 46) to be 1/m. Concurrently with those actions, the light emitting element 50 is turned on to illuminate the area of the photosensitive member 46 which is outside (rightward) of the $(m_1l_0+m_1\delta)$ area only, with the confinement by the plate 51. The optical system described with reference to FIG. 1 scans the original P to form an image of the original P on the photosensitive member 46 which is being rotated, the width of the image being $m_1l_0$. The rest of the width, i.e., the width of the photosensitive member 46, which is not illuminated by the image light reflected by the original P, is illuminated by the light emitting element 50 with the confinement of the partition 51, whereby the electric charge remained thereon is dissipated. By this, the marginal area of the image area of the photosensitive member 46 is erased.

When the magnification $m_2$ which is less than $m_1$ is selected, the focal length of the zoom lens 2 is changed to $m_2D/(m_2+1)^2$, and the position thereof is changed along the line 48 so as to set the ratio of (the length between itself and the original P)/(the length between itself and the imaging portion 8 of the photosensitive member 3) to be 1/m. Concurrently with those actions, the light emitting elements 50 and 52 are turned on to illuminate the area of the photosensitive member 46 which is outside (rightward) of the $(m_2l_0+m_2\delta)$ area only, with the confinement by the plate 51. The optical system scans the original P to form an image of the original P on the photosensitive member 46 which is being rotated, the width of the image being $m_2l_0$. The rest of the width, i.e., the width of the photosensitive member 46 which is not illuminated by the image light reflected by the original P, is illuminated by the light emitting element 50 and 52 with the limiting action of the partition plates 51 and 53, whereby the electric charge remained thereon is erased. By this, the marginal area of the photosensitive member 46 is erased.

With the foregoing description, the operation when the magnification is set to $m_3$, will be clear since it is similar. Therefore, the detailed explanation is omitted by including this case in the following Table A, which shows the relations among the selected magnifications, the operation of the light emitting elements and the area of the exposure by the elements:

TABLE A

| Magnification m | Light Emitting Element | Range of Exposure (Distance from Point $O_1'$) |
|---|---|---|
| $m \geqq m_0$ | All "off" | |
| $m_0^2 \leqq m < m_0$ | Element 50, "on"<br>Element 52, "off"<br>Element 54, "off" | From $m_0l_0$ to $m_0\delta$ or more |
| $m_0^3 \leqq m < m_0^2$ | Element 50, "on"<br>Element 52, "on"<br>Element 54, "off" | From $m_1l_0$ to $(m_0 + m_1)\delta$ or more |
| $m_0^4 \leqq m < m_0^3$ | All "on" | From $m_2l_0$ to $(m_0 + m_1 + m_2)\delta$ or more |

Figure 6:
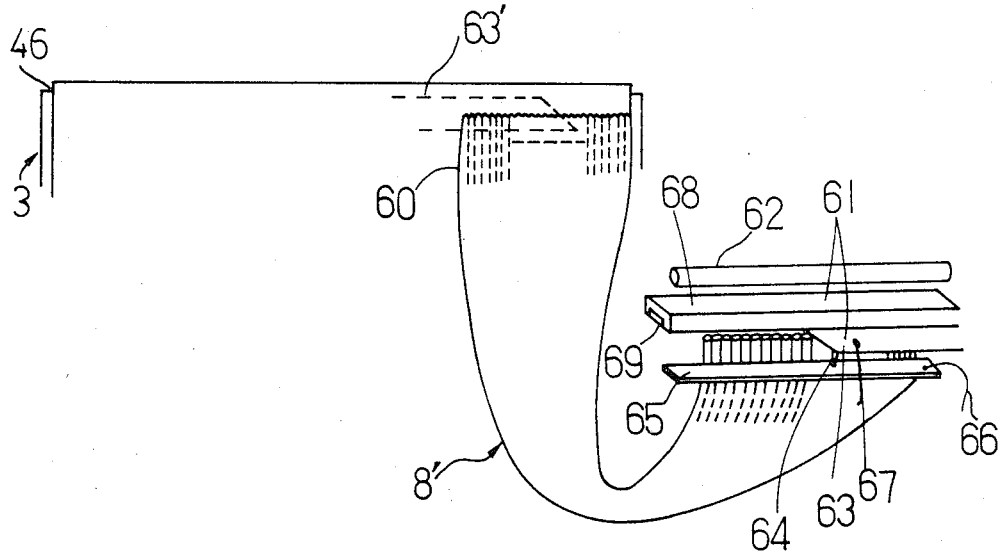
FIG. 6 shows another embodiment of the margin erasure device.

FIG. 6 shows another embodiment of the margin erasing means for an optical system capable of continuously changing the magnification, wherein reference numeral 3, 46 and 8' depict a photosensitive drum, a photosensitive member and margin erasure means, respectively. To that area of the photosensitive member 46 which requires the margin erasure, an end of an array 60 of optical fibers is faced adjacent to the photosensitive member 46 surface. The ends of the optical fibers are arranged in a line, facing the photosensitive member 46. The other ends of the optical fibers are located adjacent to a shutter 61 which is controlled in accordance with the magnification selected. Behind the shutter 61 is a light source 62 to introduce the light to the optical fibers. The shutter 61 includes a movable member 63 formed by an electrically conductive material. Adjacent to an end of the movable mirror 63, a contact 64 is fixed, which is always in contact with a resistor 65 extending along the end of the optical array 60. A lead wire 66 is connected to one end of the register 65, and another lead 67 wire is connected to the contact 64 through the movable member 63. The movable member 63 is supported by its lateral end bent into a channel 69 of a guiding plate 68 extending colaterally, so that the movable member 63 is movable along the array of the ends of the optical fibers. When a magnification is selected by the operator, the movable member 63 is driven by a driving mechanism (not shown) until the resistance between the lead wires 66 and 67 reaches a value predetermined in accordance with the magnification. By this, the movable member 63 allows the light of the light source 62 to enter the ends of the optical fibers to such an extent that the unilluminated area of the photosensitive member 46 is illuminated by way of the array 60 of the optical fibers. By using more fine fibers, the margin erasure can practically match a continuously variable magnification optical system. In the shown embodiment, the movable member 63 is provided adjacent the light incident side of the optical fibers, but the movable member can be located at the light emergent side of the fibers, as shown by the broken lines 63 in FIG. 6.

The control of the movable member 63 of the shutter in this embodiment and the control of the light emitting elements of the foregoing embodiment may be effected by a central processing unit or the like (not shown).

The foregoing description has all been made with the side registration type optical system. The center registration type will now be described.

In FIG. 3, the zoom lens 2 moves along its optical axis 48' in the case of the center registration system, wherein the center of the original P is imaged at a constant position of the photosensitive member 46, i.e., the center thereof at all magnification ratio. So, in this case, the reference point on the original supporting member 1 is the center thereof.

The optical axis 48' extends through the center of the width $l_0$ of the original supporting member 1 perpendicularly thereto. At the righthand end, as viewed in FIG. 3, of the original supporting member 1, the supporting plate 43b for the original supporting member 1 is cut back by the width $\delta'$, and provided with another white plate 44', as shown by the broken lines. In addition, adjacent to the lefthand end, as viewed in FIG. 3, of the photosensitive member 46, there are provided additional light emitting elements 50', 52' and 54', and partition plates 51', 53' and 55', all of which function and operate in the manner similar to the foregoing embodiment, in addition to, not in place of, the light emitting elements 50, 52 and 54 and partition plates 51, 53 and 55. Therefore, the margin erasure means 8' includes, in the case of the center registration system, the light emitting elements 50, 52, 54, 50', 52' and 54' and partition plates 51, 53, 55, 51', 53' and 55'.

Figure 7A:
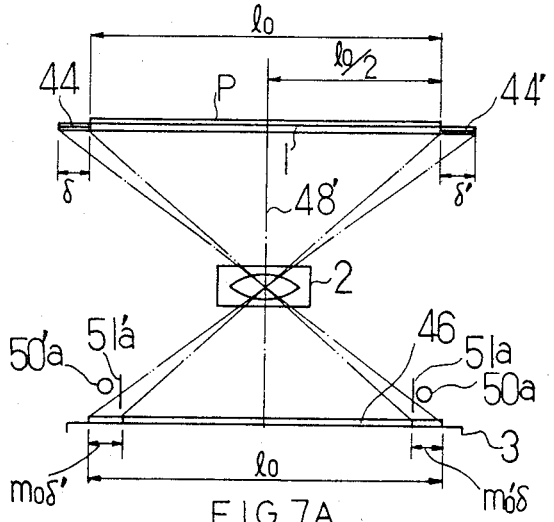
FIG. 7A shows a variable magnification optical system of a center registration type.

FIG. 7A shows a state of the optical system of a center registration type at a magnification. The margin erasure means includes, in this embodiment, light emitting elements 50a and 50a' and partition plates 51a and 51a'. The number of those element is not limiting, but, may be larger. For the sake of simplicity of the explanation, only one for each end is shown. FIG. 7A shows the states when the magnification $m'=l_0/(l_0+\delta+\delta')$. The width of the original P plus widths $\delta$ and $\delta'$ is imaged over the full width $l_0$ of the photosensitive member 46. Therefore, when $m'\geqq l_0/(l_0+\delta+\delta')$, the photosensitive member does not have an unilluminated width, so that the operation of the light emitting element 50a and 50a' is not required.

Figure 7B:
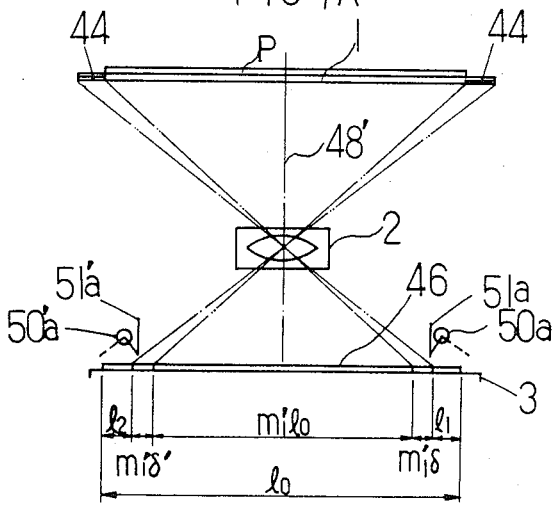
FIG. 7B shows the state of the FIG. 7A optical system at a different magnification ratio.

FIG. 7B shows the states of the optical system, when the magnification $m'=m_1'<l_0/(l_0+\delta+\delta')$. The widths of the images of the original P, white plate 44 and white plate 44' are $m_1'l_0$, $m_1'\delta$ and $m_1'\delta'$, respectively. The sum of those is less than $l_0$ which is the effective width of the photosensitive member 46, so that the photosensitive member 46 has unilluminated areas at its opposite ends. The width $l_1$ of the unilluminated area at the side where the white plate 44 is imaged, is equal to $l_0/2(1-m_1')-m_1'\delta$, and the width $l_2$ of the unilluminated area at the side where the white plate 44' is imaged, is equal to $l_0/2(1-m_1')-m_1'\delta'$. At this magnification, the light emitting element 50a and 50a' are turned on, with their illuminating area limited by the partition plates 51a and 51a', so as to illuminate the width $l_1$ and width $l_2$ of the photosensitive member 46. The elements 50a and 50a' may irradiate a part or entire area of the images of white plates 44 and 44'.

Referring to FIG. 3, if three light emitting elements are provided for each end portion, they are activated in the similar manner as with FIG. 7 in dependence of the magnification selected to erase the undesired charge at the margins.

In place of the white plates as the charge removing means, an array of light emitting diodes may be used.

The optical fiber array explained with FIG. 6 embodiment, may be used in place of the light emitting elements 50a, 50a' and the associated partition plates, in the center registration system.

The foregoing description has been made with the fixed original/original supporing member type, but it is apparent for one skilled in the art that the present invention applies to the movable original/original supporting member type.

What is claimed is:

1. A variable magnification copying apparatus, comprising:

a movable electrostatic photosensitive member;

charging, image exposure, developing and image transfer stations provided around said photosensitive member;

original supporting means for supporting thereon an original to be scanned in a scanning direction;

first erasing means for erasing electric charge of a part of said electrostatic photosensitive member, said first erasing means including a light reflecting member for reflecting light for illuminating the original, said light reflecting member being provided on a bottom face of said original supporting means at one end and extending in the direction of original scan;

a variable magnification optical system for projecting, at a selected magnification, onto said photosensitive member which has been electrically charged, an image of the original supported on said original supporting means and the light emitted from said first erasing means; and second erasing means for erasing electric charge from a part of said photosensitive member which is adjacent to the area illuminated by the light from said first erasing means, upon the magnification being less than a predetermined magnification.

2. An apparatus according to claim 1, wherein said second erasing means includes a light emitting element which is provided along an end of said photosensitive member for erasing in the direction of original scan.

3. An apparatus according to claim 1, wherein said electrostatic photosensitive member has width $l_0$ in the direction perpendicular to the direction of original scan; said original supporting means has a copyable area of the same width $l_0$ in the direction perpendicular to the direction of original scan; and said first erasing means has width $\delta$ in the perpendicular direction; and wherein said second erasing means operates when the magnification is less than $l_0/(l_0+\delta)$.

4. An apparatus according to claim 1, wherein said second erasing means includes a light emitting element adjacent an end of said photosensitive member, and a member for confining the area of said photosensitive member illuminated by the light emitting element.

5. An apparatus according to claim 1, wherein said second erasing means includes an array of optical fibers, the ends of each of which are arranged in respective lines, and an end of which is faced to an end of said photosensitive member, and wherein said second erasing means further includes a movable member for confining the area of said photosensitive member illuminated by the array.

6. A variable magnification copying apparatus, comprising:

a movable electrostatic photosensitive member;

charging, image exposure, developing and image transfer stations provided around said photosensitive member;

original supporting means for supporting thereon an original to be scanned in a scanning direction;

first erasing means for erasing electric charge of a part of said electrostatic photosensitive member, said first erasing means including first and second reflecting members provided on a bottom face of said original supporting means at its respective ends and extending in the direction of original scan;

a variable magnification optical system for projecting, at a selected magnification, onto said photosensitive member which has been electrically charged, an image of the original supported on said original supporting means and the light emitted from said first erasing means; and second erasing means for erasing electric charge from a part of said photosensitive member which is adjacent to the area illuminated by the light from said first erasing means, upon the magnification being less than a predetermined magnification.

7. An apparatus according to claim 6, wherein said second erasing means includes first and second light emitting elements along respective ends of said photosensitive member for erasing in the direction of original scan.

8. An apparatus according to claim 6, wherein said electrostatic photosensitive member has width $l_0$ in the direction perpendicular to the direction of original scan; said original supporting means has a copyable area of the same width $l_0$ in the direction perpendicular to the direction of original scan; one of said first and second members or elements of said first erasing means has width $\delta$ in the perpendicular direction; and the other has width $\delta'$ in the perpendicular direction; and wherein said second erasing means operates when the magnification is less than $l_0/(l_0+\delta+\delta')$.

9. An apparatus according to claim 6, wherein said second erasing means includes light emitting elements adjacent respective ends of said photosensitive member, and members for confining the area of said photosensitive member illuminated by the respective light emitting elements.

10. An apparatus according to claim 6, wherein said second erasing means includes arrays of optical fibers, the ends of each of which arrays are arranged in respective lines, and the ends of respective arrays are faced to the ends of said photosensitive member, and wherein said second erasing means further includes movable members for confining the area of said photosensitive member illuminated by the arrays.

11. A variable magnification copying apparatus with charge erasing device, comprising:

a movable electrostatic photosensitive member;

charging, image exposure, developing and image transfer stations provided around said photosensitive member;

original supporting means having a surface for supporting thereon an original to be scanned in a scanning direction;

first erasing means for easing electric charge of a part of said electrostatic photosensitive member, said first erasing means including light reflecting means, disposed below the original supporting surface, for reflecting light for illuminating said orginal, said first erasing means being operable, when a magnification is selected from a first range of magnification, to erase electric charge from said photosensitive member;

a variable magnification optical system for projecting, at the selected magnification, onto said photosensitive member which has been electrically charged, an image of the original supported on said original supporting means and the light emitted from said first erasing means; and second erasing means for erasing electric charge from a part of said photosensitive member which is adjacent to the area illuminated by the light from said first erasing means, said second erasing means being cooperable, when a magnification is selected from a second range of magnification which is smaller than that of the first range, with said first erasing means to erase electric charge from said photosensitive member.

12. An apparatus according to claim 11, wherein said light reflecting means is located adjacent that side of said original supporting means which is remote from a reference for placing the original thereon.

13. An apparatus according to claim 12, wherein said light reflecting means is provided on a bottom face of said original supporting means at its one end extending in the direction of original scan.

14. An apparatus according to any one of claims 11, 12, or 13, wherein said electrostatic photosensitive member has width $l_0$ in the direction perpendicular to the direction of original scan; said original supporting means has a copyable area of the same width $l_0$ in the direction perpendicular to the direction of original scan; and said first erasing means has width $\delta$ in the perpendicular direction; and wherein said second erasing means operates when the magnification is less than $l_0/(l_0+\delta)$.

15. An apparatus according to any one of claims 11, 12 or 13, wherein said second erasing means includes a light emitting element adjacent an end of said photosensitive member, and a member for confining the area of said photosensitive member illuminated by the light emitting element.

16. An apparatus according to any one of claims 11, 12 or 13, wherein said second erasing means includes an array of optical fibers, the ends of each of which are arranged in respective lines, and an end of which is faced to an end of said photosensitive member, and wherein said second erasing means further includes a movable member for confining the area of said photosensitive member illuminated by the array.

17. An apparatus according to claim 11, wherein said light reflecting means is provided at opposite sides of an original supporting area of said original supporting means.

18. An apparatus according to claim 17, wherein said light reflecting means includes first and second reflecting members for reflecting light for illuminating the original.

19. An apparatus according to claim 18, wherein said first and second reflecting members provided on a bottom face of said original supporting means at its respective ends and extending in the direction of original scan.

20. An apparatus according to any one of claims 17 through 19, wherein said electrostatic photosensitive member has width $l_0$ in the direction perpendicular to the direction of original scan; said original supporting means has a copyable area of the same width $l_0$ in the direction perpendicular to the direction of original scan; one of said first and second reflecting members of said first erasing means has width $\delta$ in the perpendicular direction; and the other has width $\delta'$ in the perpendicular direction; and wherein said second erasing means operates when the magnification is less than $l_0/(l_0+\delta+\delta')$.

21. An apparatus according to any one of claims 17 through 19, wherein said second erasing means includes light emitting elements adjacent respective ends of said photosensitive member, and members for confining the area of said photosensitive member illuminated by the respective light emitting elements.

22. An apparatus according to any one of claims 17 through 19, wherein said second erasing means includes arrays of optical fibers, the ends of each of which arrays are arranged in respective lines, and the ends of respective arrays are faced to the ends of said photosensitive member, and wherein said second erasing means further includes movable members for confining the area of said photosensitive member illuminated by the arrays.

* * * * *

UNITED STATES PATENT AND TRADEMARK OFFICE

CERTIFICATE OF CORRECTION

PATENT NO. : 4,552,447

DATED : November 12, 1985

INVENTOR(S) : SEJI SAGARA, ET AL.

It is certified that error appears in the above-identified patent and that said Letters Patent is hereby corrected as shown below:

Column 3, line 15, change "are" to --and--;
line 16, change "synchronizm" to --synchronism--.
Column 5, line 50, change "marging" to --margin--.
Column 6, line 9, change "equals to" to --equals--;
line 47, change "type). The" to --type), the--.
Column 7, line 9, change "for" to --from--;
line 38, change "remained" to --remaining--;
line 60, change "remained" to --remaining--.
Column 8, line 35, change "lead 67 wire" to --lead wire 67--.
Column 9, line 25, change "element" to --elements--;
line 33, change "element" to --elements--;
line 47, change "element" to --elements--;
line 65, change "supporing" to --supporting--.

UNITED STATES PATENT AND TRADEMARK OFFICE

CERTIFICATE OF CORRECTION

PATENT NO. : 4,552,447

DATED : November 12, 1985

INVENTOR(S) : SEJI SAGARA, ET AL.

It is certified that error appears in the above-identified patent and that said Letters Patent is hereby corrected as shown below:

Column 11, line 51, change "for easing" to --for erasing--.

Column 12, line 48, change "members provided" to --members are provided--.

Signed and Sealed this

Sixth Day of January, 1987

*Attest:*

*Attesting Officer*

DONALD J. QUIGG

*Commissioner of Patents and Trademarks*